US008756935B2

(12) United States Patent
Duval et al.

(10) Patent No.: US 8,756,935 B2
(45) Date of Patent: Jun. 24, 2014

(54) GAS TURBINE ENGINE COMBUSTION CHAMBER COMPRISING CMC DEFLECTORS

(75) Inventors: Sylvain Duval, Tournan en Brie (FR); Didier Hippolyte Hernandez, Quiers (FR); Romain Nicolas Lunel, Montereau sur le Jard (FR)

(73) Assignee: SNECMA, Paris (FR)

( * ) Notice: Subject to any disclaimer, the term of this patent is extended or adjusted under 35 U.S.C. 154(b) by 789 days.

(21) Appl. No.: 12/997,266

(22) PCT Filed: Jun. 10, 2009

(86) PCT No.: PCT/EP2009/057147

§ 371 (c)(1),
(2), (4) Date: Dec. 10, 2010

(87) PCT Pub. No.: WO2010/000583

PCT Pub. Date: Jan. 7, 2010

(65) Prior Publication Data

US 2011/0113789 A1 May 19, 2011

(30) Foreign Application Priority Data

Jun. 10, 2008 (FR) ..... 08 03226

(51) Int. Cl.
*F02C 1/00* (2006.01)
*F02G 3/00* (2006.01)

(52) U.S. Cl.
USPC ..... 60/756; 60/800; 60/752

(58) Field of Classification Search
USPC ..... 60/752–760, 737, 740, 746, 747, 748, 60/796, 799, 800
See application file for complete search history.

(56) References Cited

U.S. PATENT DOCUMENTS

| | | | | |
|---|---|---|---|---|
| 4,180,974 | A * | 1/1980 | Stenger et al. | 60/748 |
| 5,970,716 | A | 10/1999 | Forrester et al. | |
| 5,996,335 | A | 12/1999 | Ebel | |
| 6,212,870 | B1 * | 4/2001 | Thompson et al. | 60/772 |
| 6,442,940 | B1 * | 9/2002 | Young et al. | 60/748 |
| 6,581,386 | B2 * | 6/2003 | Young et al. | 60/748 |
| 7,891,190 | B2 * | 2/2011 | Commaret et al. | 60/737 |
| 2003/0131600 | A1 * | 7/2003 | David et al. | 60/737 |
| 2007/0033950 | A1 * | 2/2007 | Bernier et al. | 60/796 |
| 2007/0084215 | A1 * | 4/2007 | Hernandez et al. | 60/796 |
| 2007/0199329 | A1 | 8/2007 | Hernandez et al. | |
| 2011/0271682 | A1 * | 11/2011 | Sandelis | 60/737 |

FOREIGN PATENT DOCUMENTS

FR 2 897 922 8/2007

OTHER PUBLICATIONS

International Search Report issued Jun. 9, 2010 in PCT/EP09/057147 filed Jun. 10, 2009.

* cited by examiner

*Primary Examiner* — William H Rodriguez
(74) *Attorney, Agent, or Firm* — Oblon, Spivak, McClelland, Maier & Neustadt, L.L.P.

(57) ABSTRACT

A gas turbine engine combustion chamber including at least one deflector mounted on the chamber end wall and including an opening for a carburetted air supply device. The deflector includes an opening, corresponding to the chamber end wall opening, with an annular cylindrical part for attachment to the wall, the cylindrical part including a mechanical attachment mechanism collaborating with a complementary attachment mechanism on a metal sleeve secured to the wall and a cylindrical centering cup fixed by one end to the sleeve and housed inside the cylindrical part of the deflector.

8 Claims, 4 Drawing Sheets

GAS TURBINE ENGINE COMBUSTION CHAMBER COMPRISING CMC DEFLECTORS

BACKGROUND OF THE INVENTION

1. Field of the Invention

The present invention relates to the field of gas turbine engines and, in particular, to that of the combustion chambers of such engines.

2. Description of the Related Art

The combustion chamber of a gas turbine engine receives compressed air from an upstream high-pressure compressor and provides a gas that is heated by combustion in a combustion zone supplied with fuel. The chamber thus comprises a chamber end wall situated upstream and to which the various fuel injection systems are attached. FIG. 1 shows a chamber of the prior art. The annular chamber 1 is housed inside an engine casing 2 downstream of the compressed air diffuser 3. It comprises an interior wall 4 and an exterior wall 5 between them delimiting a combustion zone. In its upstream part, the chamber comprises a transverse chamber end wall 6 on which openings are formed, each opening being equipped with a carbureted-air supply system 7. Such a system is supplied with fuel from a liquid-fuel injector and comprises concentric cascades of vanes to create streams of air that swirl, encouraging them to mix with the layer of atomized fuel.

Some of the air from the diffuser is diverted away from the fuel intake zone by the fairing 8 and flows along and around the outside of the exterior wall and along and around the outside of the interior wall.

The proportion which passes along inside the carburetion zone, crosses the chamber end wall 6 and the mixture is ignited by sparkplugs arranged on the exterior annular wall. The primary combustion zone is therefore situated immediately downstream of the chamber end wall. Deflectors 9 made of a metallic material line the inside of the chamber end wall and their function is to protect it from the intense radiation produced in the primary combustion zone. Air is introduced through orifices made in the chamber end wall behind the deflectors in order to cool them. This air flows along the rear face of the deflectors and is then guided so that it forms a film along the longitudinal exterior walls of the chamber.

Because the chamber end wall deflectors are not mechanically stressed, have no structural role and their only function is to afford thermal protection, and with a view to optimizing the air flows, it would be desirable to be able to reduce the stream along the chamber end wall and assign part of it to another function, notably that of cooling the interior or exterior walls.

Also, increasingly improved engine performance leads to increasingly high chamber temperatures being sustained. In order to conform to chamber life specifications, it would be necessary to intensify the cooling of the chamber walls and of the chamber end wall deflector. The solution involving increasing the cooling flow rate would be detrimental to chamber efficiency.

In order to solve this problem, the proposal is for the known metal deflector to be replaced with a CMC (ceramic matrix composite) deflector. The high-temperature capability of this material is far better than that of metal. This solution will make it possible to control the flow of deflector cooling air and, for the same chamber operating temperature, reduce it, so that a proportion of it can be reassigned to some other function or, alternatively, to allow higher operating temperatures to be tolerated for the same cooling air flow.

CMCs, ceramic matrix components, are known per se. They are formed of a carbon fiber or refractory reinforcement and of a ceramic matrix. The manufacture of a CMC involves producing a fibrous preform intended to constitute the reinforcement of the structure, and densifying the preform with the ceramic material of the matrix. CMCs have the advantage of maintaining their mechanical properties up to high temperatures in an oxidizing environment.

Fitting a component of this type in a metal structure does, however, present difficulties notable because of the substantial difference in their expansion coefficients. A CMC has a thermal expansion rate that is one quarter of that of the metal used for the chamber. Moreover, this material can be neither welded nor brazed.

BRIEF SUMMARY OF THE INVENTION

The applicant company has set itself the task of developing a way of fitting deflectors made of materials of the CMC type, on the end wall of a combustion chamber.

According to the invention, this objective is achieved using a combustion chamber that has the features listed in the main claim.

The sleeve is preferably fixed to the wall by brazing and the mechanical fastening means is of the jaw coupling type. Radial teeth on one of the two components, the cylindrical part of the deflector or the metal sleeve, engage with a groove in the other component.

The deflector is thus held in position without brazing. This solution makes it possible, at high temperatures, to hold the deflector in position against the sleeve. Specifically, as it expands, the cup will engage with the cylindrical part of the deflector.

Advantageously, the cup is fitted with clearance inside the cylindrical part of the deflector when the combustion chamber is cold, the clearance becoming smaller if not being eliminated at the combustion chamber operating temperatures. This clearance allows the components to be assembled and takes their difference in expansion into consideration.

More specifically, the cup comprises a radial flange by which it is fixed by welding to the metal sleeve.

The carbureted air supply system comprises a bowl fixed by a flange to the metal sleeve.

According to an alternative form of embodiment, the mechanical means of attachment of the deflector collaborates with a deflector support attached to the sleeve. This support forms an intermediate component which allows the zones where the metal components are brazed together to be separated from one another without the risk of damaging the CMC material of which the deflector is made.

As in the previous embodiment, the cylindrical part of the deflector is secured to a cup-forming cylindrical element housed with clearance, when cold, inside the annular flange of the deflector, said cup-forming element guiding the deflector when the temperature has increased.

BRIEF DESCRIPTION OF THE SEVERAL VIEWS OF THE DRAWINGS

Two nonlimiting embodiments of the invention will now be described in greater detail with reference to the attached drawings in which.

DETAILED DESCRIPTION OF THE INVENTION

Figure 1:
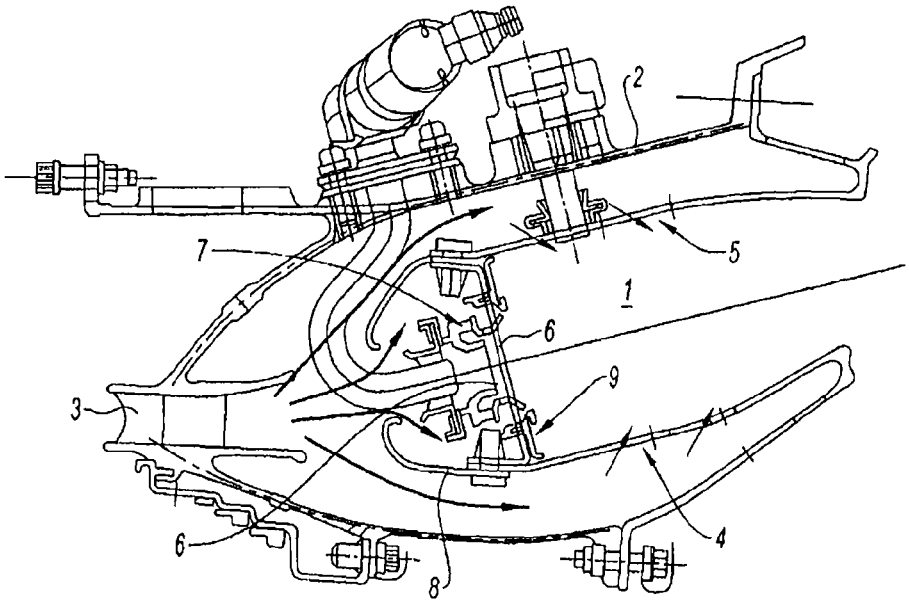
Fig. 1 Background Art
FIG. 1 depicts an axial half-section of a combustion chamber of a gas turbine engine of the prior art, FIG. 2 partially depicts the chamber end wall according to the invention in axial section, with an enlarged detail which shows the zone in which the deflector is mounted in the end of the chamber in greater detail.
Figure 2:
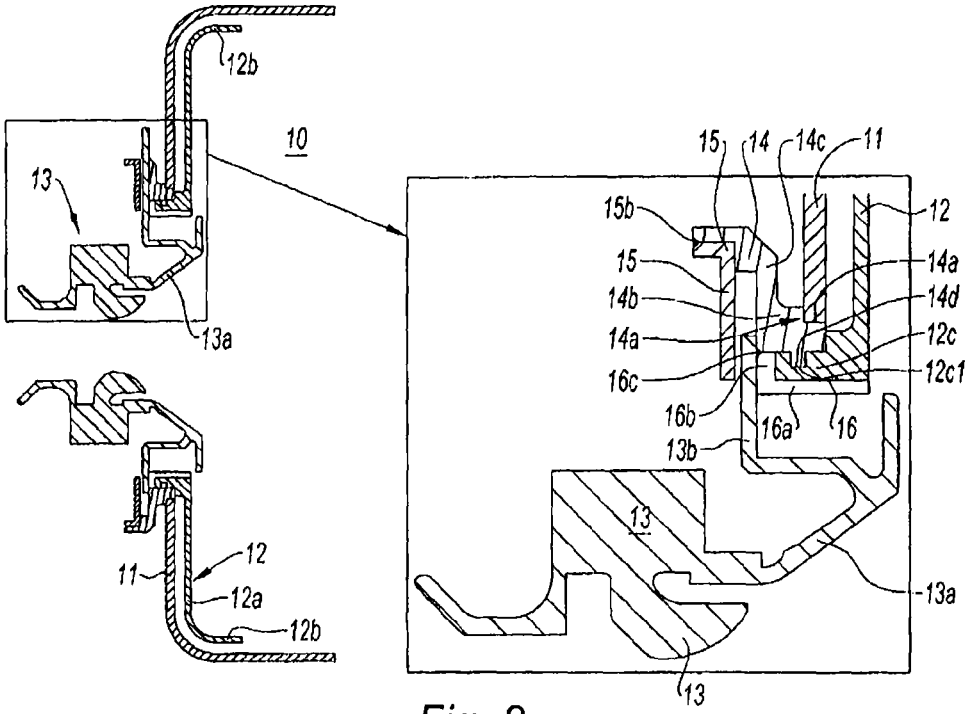

FIG. 2 shows a chamber end according to one embodiment of the invention. The end wall 11 of the chamber 10 is protected from the radiation of the combustion zone by a deflector 12 made of CMC. The shape of the deflector is approximately the same as that of the deflector 9 of the prior art with a generally flat part 12*a* positioned parallel to the wall 11 and two parts 12*b* which curve toward the exterior and interior walls. The deflector 12 is open in its central part with a cylindrical part 12*c* of the same axis as the carbureted air supply system 13.

Fixed in the opening in the chamber end wall 11 is a metal sleeve 14. A brazed joint 14*a* holds the sleeve 14 against the interior edge of the opening in wall 11. The sleeve comprises a cylindrical part 14*b* and a radial part 14*c*, the latter creating a space with a retaining cup 15 which is welded to its periphery. Transverse teeth 14*d* directed toward the axis of the opening in the wall 11 are created on the inside of the cylindrical part 14*b* of the sleeve 14. A centering cup 16 comprises a cylindrical part 16*a* and a radial and transverse flange 16*b*. The cup 16 is positioned inside the cylindrical part 14*b* of the sleeve and fixed by a peripheral welded seam 16*c* to the sleeve 14. The cylindrical part 16*a* of the cup is inside the cylindrical part 12*c*.

The deflector 12 comprises a transverse groove 12*c*1 on the exterior face of the cylindrical part 12*c*, forming a housing for the teeth 14*d* of the sleeve. The groove is perforated to allow the teeth 14*d* to pass axially at the time of fitting and then to allow locking by rotating the sleeve with respect to the cylindrical part 12*c* of the deflector 12. This method of mechanical attachment of the deflector to the sleeve is of the jaw coupling type. Other means of mechanical attachment are conceivable. As may be seen from FIG. 2*a*, the cylindrical part 16*a* of the cup is inside the cylindrical part 12*c*, with a radial clearance at the time of fitting.

The air carburetion and injection device is depicted overall using the reference 13. Given that the subject matter of the invention does not concern it, its details are not given. The divergent bowl 13*a* of the device externally comprises a transverse flange 13*b* housed in the space formed between the radial face 14*c* of the sleeve 14 and the retaining cup 15.

This is how the assembly is constructed.

Figure 3:
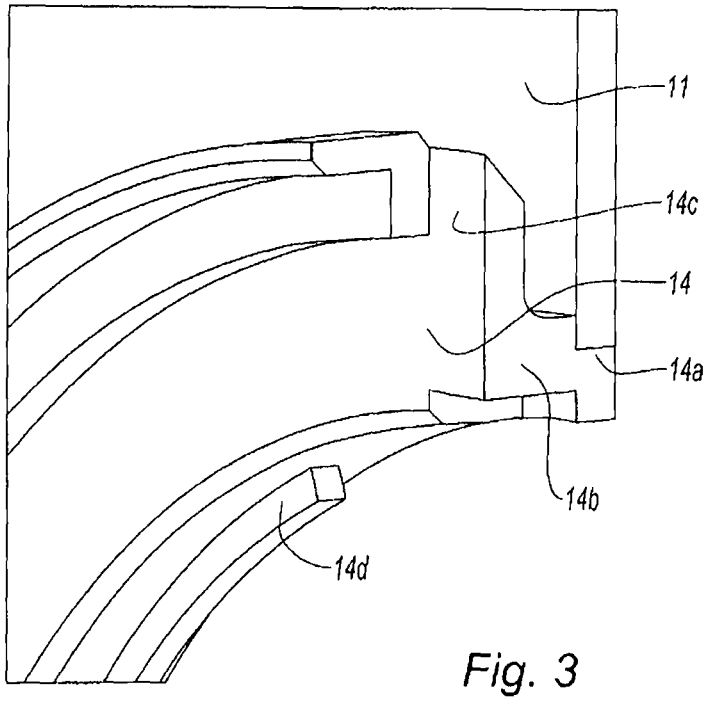
FIGS. 3 to 6 show the succession of steps for fitting the deflector in the end of the chamber.

The sleeve 14 is brought, FIG. 3, against the chamber end wall 11 on the outside of the chamber. It is centered on the interior edge of the corresponding opening in the wall 11.

Figure 4:
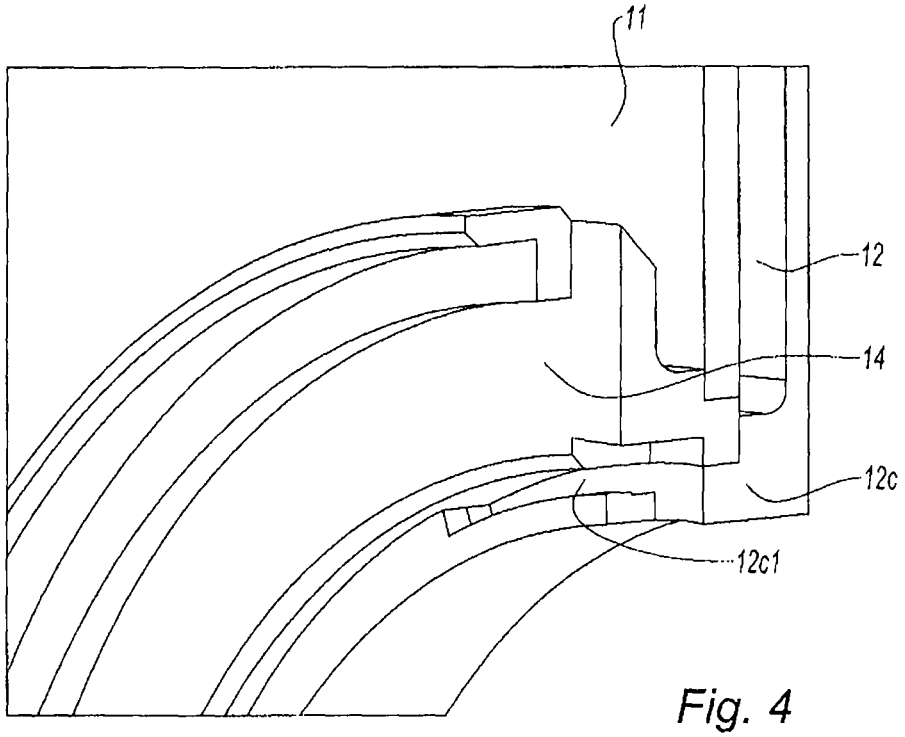

The deflector 12 is positioned, FIG. 4, in the sleeve 14 from inside the chamber. The teeth 14*d* are introduced axially through the perforations into the groove 12*c*1. The sleeve 14 is turned to lock the teeth axially in relation to the annular flange 12*c*. The sleeve 14 is therefore coupled to the deflector 12 by the collaboration between the teeth 14*d* and the groove 12*c*1.

Figure 5:
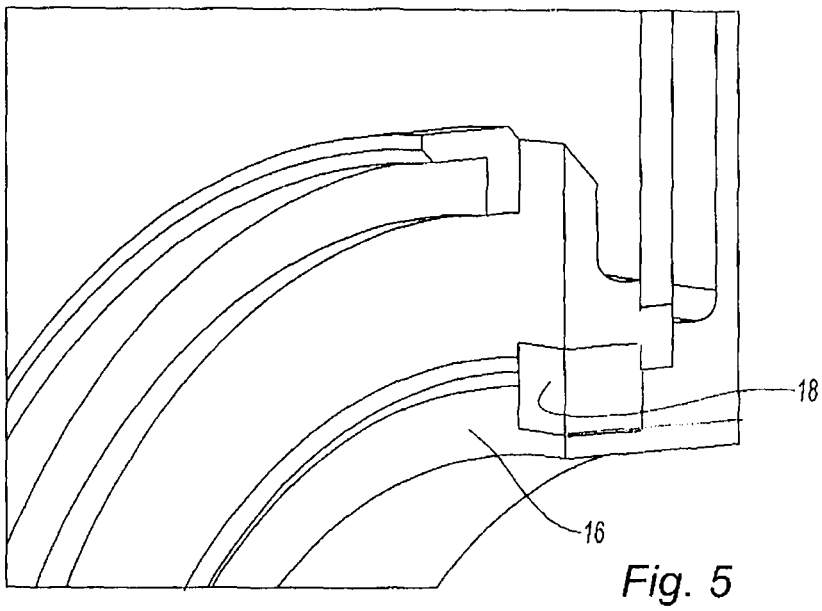
Figure 6:
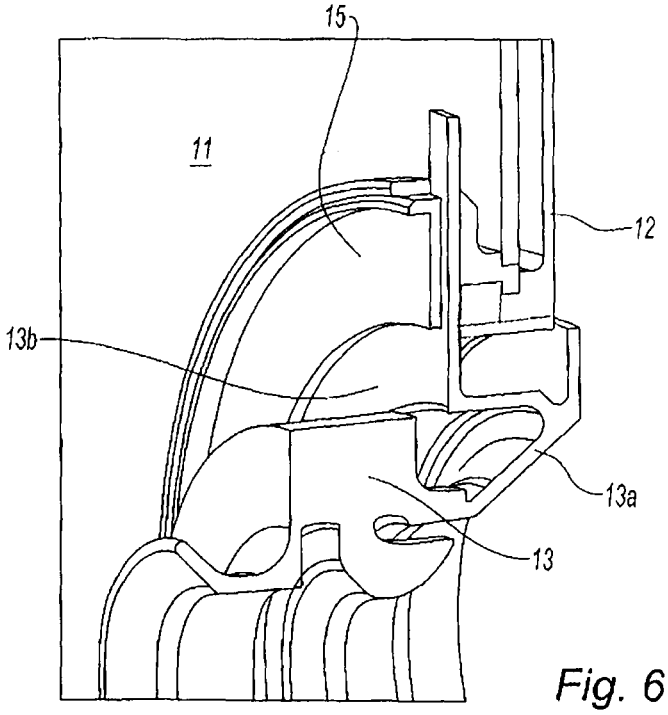

The sleeve 14 is fixed, FIG. 5, by brazing it to the chamber end wall using the brazed seam 14*a*, FIG. 2, and a rotation-preventing pin 18 is placed between the diameter of the sleeve and that of the deflector. The centering cup 16 is slid into the cylindrical part 12*c* of the deflector, and the cup is attached by a spot or seam of welding 16*c* between this cup and the sleeve 14.

The fuel injection device 13 is then fitted and immobilized using the retaining cup 15. This cup is welded to the sleeve.

This way of fitting the deflector allows the latter to be immobilized in the chamber end wall using a mechanical means of fastening. The welds are only between metal parts. The differential expansion of the deflectors with respect to the metallic environment are accounted for by the centering cup which, by expanding radially, immobilizes the deflector in position.

The clearances between the sleeve and the deflector on the one hand and between the deflector and the centering cup on the other need to be optimized according to the operating temperatures and the diameter of the components.

Figure 7:
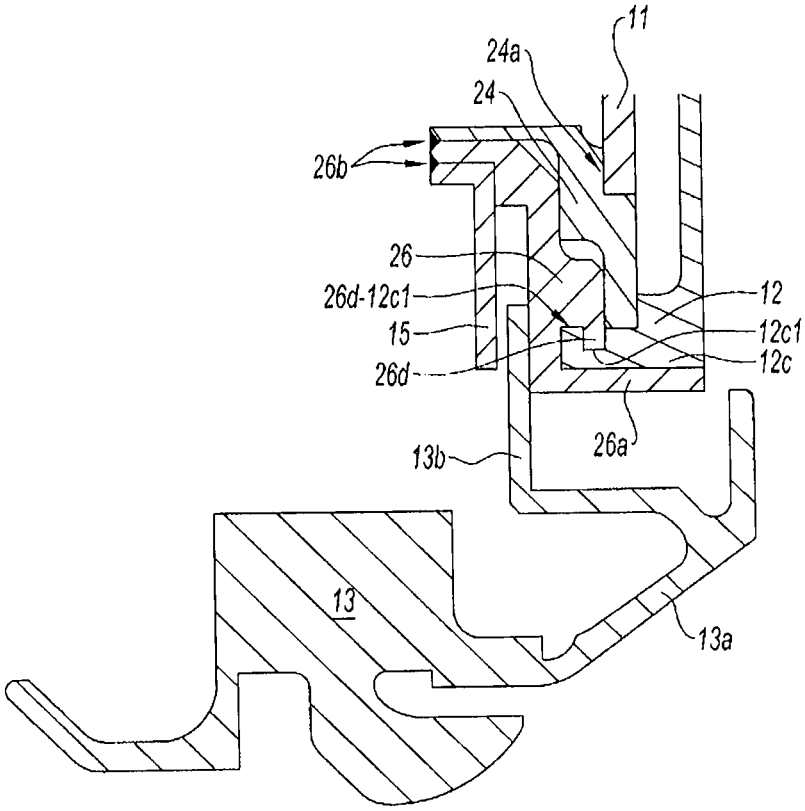
FIG. 7 is an axial section of an alternative form of embodiment of the invention.

An alternative form of embodiment is now described with reference to FIG. 7.

Fitting is roughly the same as before; the sleeve and the cup have simply been modified.

The deflector 12 and the chamber end wall 11 remain unchanged. An intermediate sleeve 24 is fitted into the opening in wall 11 from the outside of the chamber; it is brazed at 24*a* along the edge of the opening. The deflector is introduced into the intermediate sleeve 24 from inside the chamber. An annular deflector support sleeve 26 comprises transverse teeth 26*d* engaging with the exterior groove 12*c*1 of the annular flange of the deflector. The support sleeve 26 is slid axially from outside the chamber introducing the teeth 26*d* into the groove 12*c*1 via the perforations (not visible) of the groove. A rotation about the axis of the opening allows the support sleeve 24 to be coupled to the deflector. In order to maintain the mechanical connection between the support sleeve and the deflector, all that is required is for the support sleeve 26 to be welded, at 26*b*, to the intermediate sleeve 24 at the periphery distant from the CMC deflector.

The support sleeve 26 comprises a cylindrical part 26*a* that forms a radially interior cylindrical centering cup which fits inside the flange 12*c*. When fitted cold, a clearance is left between the cylindrical part 26*a* of the support sleeve and the flange 12*c* of the deflector. Centering is achieved by the mechanical jaw-coupling means of attachment.

At the combustion chamber operating temperature, the deflector support sleeve, notably, expands more than the CMC deflector. The cylindrical part comes to press against the internal face of the flange 12*c* firmly and centers the deflector.

The fuel injection device 13 is fitted, as before, from the outside of the chamber, a transverse flange 13*b* being immobilized between the rear face of the deflector support 26 and a retaining cup 15 brazed to the support.

The invention claimed is:

1. A combustion chamber for a gas turbine engine comprising:

a deflector comprising ceramic matrix composite (CMC) material which is mounted on a chamber end wall including an opening for a carbureted air supply device; and a metal sleeve secured to an interior edge of the opening of the chamber end wall, wherein the deflector comprises an opening, corresponding to the chamber end wall opening, with an annular cylindrical part, wherein an outer circumferential surface of the cylindrical part comprises an annular groove collaborating with an annular tooth provided on an inner circumferential surface of the metal sleeve, wherein the deflector is free of a weld joint and free of a brazed joint, and wherein a cylindrical centering cup is fixed at a first end to the sleeve and housed with clearance inside the cylindrical part when the combustion chamber is cold, the clearance becoming smaller if not being eliminated at the combustion chamber operating temperatures.

2. The combustion chamber as claimed in claim 1, the groove and the tooth present a jaw coupling type fastener.

3. The combustion chamber as claimed in claim 1, wherein the cup comprises a radial flange which is fixed to the metal sleeve.

4. The combustion chamber as claimed in claim 1, wherein the carbureted air supply device comprises a bowl fixed by a flange to the metal sleeve.

5. The combustion chamber as claimed in claim 1, wherein the groove is perforated through which the tooth passes axially prior to locking the metal sleeve with respect to the cylindrical part of the deflector.

6. A combustion chamber for a gas turbine engine comprising:

at least one deflector mounted on a chamber end wall including an opening for a carbureted air supply device, wherein the deflector comprises an opening, corresponding to the chamber end wall opening, with an annular cylindrical part for attachment to the wall, the cylindrical part comprising a mechanical fastening means collaborating with a complementary fastening means on a metal sleeve secured to the wall and a cylindrical centering cup fixed by one end to the sleeve and housed with clearance inside the cylindrical part when the combustion chamber is cold, the clearance becoming smaller if not being eliminated at the combustion chamber operating temperatures, wherein the mechanical fastening means is of jaw coupling type, and wherein the jaw coupling means of attachment of the deflector collaborates with a deflector support sleeve attached to an intermediate sleeve.

7. The combustion chamber as claimed in claim 6, wherein the deflector support sleeve is secured to a cup-forming cylindrical element housed with clearance, when cold, inside the annular cylindrical part of the deflector, the cup-forming cylindrical element centering the deflector when the temperature has increased.

8. The combustion chamber as claimed in claim 6, wherein the deflector support sleeve is fixed by brazing a distance away from the deflector.

* * * * *